US009926832B2

(12) United States Patent
Birschbach et al.

(10) Patent No.: US 9,926,832 B2
(45) Date of Patent: Mar. 27, 2018

(54) REVERSE FIN COOLING FAN

(71) Applicant: Briggs & Stratton Corporation, Wauwatosa, WI (US)

(72) Inventors: Brett Birschbach, Wauwatosa, WI (US); Rodney John Balzar, West Bend, WI (US); Jeffrey P. Feist, Brookfield, WI (US); Casey Edward Groh, Milwaukee, WI (US); Brian Thomas Johnson, Kewaskum, WI (US); Randall J. Klotka, Grafton, WI (US); Darwin A. Podhola, Mukwonago, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 14/695,999

(22) Filed: Apr. 24, 2015

(65) Prior Publication Data

US 2016/0312684 A1 Oct. 27, 2016

(51) Int. Cl.

| | |
|---|---|
| ***F01P 5/04*** | (2006.01) |
| ***F01P 11/12*** | (2006.01) |
| ***F01P 5/06*** | (2006.01) |
| ***F04D 29/28*** | (2006.01) |

(52) U.S. Cl.

CPC ..... *F01P 5/04* (2013.01); *F01P 5/043* (2013.01); *F01P 5/06* (2013.01); *F01P 11/12* (2013.01); *F04D 29/281* (2013.01)

(58) Field of Classification Search

CPC .... F01P 11/12; F01P 11/10; F01P 5/02; F01P 5/06; F04D 29/326; F04D 29/281; F04D 29/164; F04D 29/325; F04D 19/002

USPC ..... 123/41.11, 41.56, 41.63, 41.65

See application file for complete search history.

(56) References Cited

U.S. PATENT DOCUMENTS

| | | | | |
|---|---|---|---|---|
| 4,358,245 | A | 11/1982 | Gray | |
| 6,372,005 | B1 * | 4/2002 | Fiacco | B01D 45/14 55/400 |
| 6,514,304 | B2 * | 2/2003 | Fiacco | B01D 45/14 55/400 |
| 6,726,734 | B2 * | 4/2004 | Bayer | A01D 34/828 55/297 |
| 7,225,765 | B2 * | 6/2007 | Leech | F01P 5/06 123/198 E |
| 7,794,204 | B2 | 9/2010 | Stevens et al. | |
| 8,091,177 | B2 * | 1/2012 | Cote | F04D 29/329 16/203 |
| 8,746,186 | B2 * | 6/2014 | Sullivan | F01P 11/12 123/198 E |

(Continued)

*Primary Examiner* — Long T Tran

(74) *Attorney, Agent, or Firm* — Foley & Lardner LLP

(57) ABSTRACT

An engine assembly includes a crankcase, a shaft, a housing, and a cooling fan. The shaft is coupled to the crankcase and defines a rotational axis. The housing has a sidewall that defines an internal space. The cooling fan is disposed at least partially within the internal space and is coupled to the shaft. The cooling fan includes a plate defining an upper surface and a lower surface. The plate is positioned to rotate with the shaft about the rotational axis. The cooling fan also includes a band that has an inner band radius and an outer band radius. The cooling fan also includes a plurality of reversed fins coupled to the band and extending from the upper surface of the plate, further radially outward from the rotational axis than the band.

19 Claims, 11 Drawing Sheets

(56) References Cited

U.S. PATENT DOCUMENTS

| | | | | |
|---|---|---|---|---|
| 2009/0293835 | A1 | 12/2009 | Nakamizo | |
| 2012/0027597 | A1 | 2/2012 | Kang et al. | |
| 2014/0053793 | A1* | 2/2014 | Sullivan | F01P 11/12 123/41.65 |
| 2014/0053794 | A1* | 2/2014 | Matel | F04D 29/281 123/41.65 |
| 2015/0192143 | A1* | 7/2015 | Sakai | F04D 29/30 415/203 |
| 2015/0192413 | A1 | 7/2015 | Bellusci et al. | |

* cited by examiner

REVERSE FIN COOLING FAN

BACKGROUND

The present invention relates generally to the field of small air-cooled internal combustion engines, and particularly to the field of cooling fans for small air-cooled internal combustion engines.

SUMMARY

One embodiment relates to an engine assembly. The engine assembly includes a crankcase, a shaft, a housing, and a cooling fan. The shaft is coupled to the crankcase and defines a rotational axis. The housing has a sidewall that defines an internal space. The cooling fan is disposed at least partially within the internal space and is coupled to the shaft. The cooling fan includes a plate defining an upper surface and a lower surface. The plate is positioned to rotate with the shaft about the rotational axis. The cooling fan also includes a band that has an inner band radius and an outer band radius. The cooling fan also includes a plurality of reversed fins coupled to the band and extending from the upper surface of the plate. The plurality of reversed fins extend radially outward from the rotational axis along a plurality of paths that are concave relative to a clockwise direction when viewed from above the cooling fan. The plurality of reversed fins extend further radially outward from the rotational axis than the band.

Another embodiment relates to a fan assembly that includes a cooling fan and a screen. The cooling fan defines a central axis and includes a plate defining an upper surface and a lower surface, a band having an inner band radius and an outer band radius, and a plurality of reverse fins coupled to the band and extending from the upper surface of the plate. The plurality of reversed fins extend radially outward from the central axis along a plurality of paths that are concave relative to a clockwise direction when viewed from above the cooling fan. The plurality of reversed fins extend to a plurality of tips that are positioned further radially outward from the central axis than the band. The screen is coupled to the cooling fan and is disposed along the plurality of reversed fins. The screen includes a hub positioned orthogonal to the central axis and a plurality of blades extending radially outward from the hub. A leading edge is the thinnest cross-sectional portion of each of the plurality of blades.

Another embodiment relates to a cooling fan. The cooling fan includes a plate having an upper surface and a lower surface and defining a central axis, a band having an inner band radius and an outer band radius, and a plurality of reverse fins coupled to the band and extending from the upper surface of the plate. The plurality of reversed fins extend radially outward from the central axis along a plurality of paths that are concave relative to a clockwise direction when viewed from above the cooling fan. The plurality of reversed fins extend from a plurality of roots positioned a root radius from the central axis to a plurality of tips positioned a tip radius from the central axis, and the tip radius is greater than the outer band radius such that the plurality of tips protrude further radially outward from the central axis than the band.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying figures, in which like reference numerals refer to like elements.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to one embodiment, a cooling fan as described herein is a fan used to move air and thereby cool an engine. The cooling fan may be provided as part of an engine assembly or as part of a fan assembly, among other alternatives. The cooling fan provides a flow of air that passes along a surface of the engine that has a high temperature and cools the surface by convection processes. A clockwise rotation of the cooling fan (e.g., when viewed from above with the cooling fan and engine installed in a normal operating position, etc.), causes relatively cool air to be drawn from outside the engine, down through the fan, and to pass over the relatively hot surfaces of the engine. The engine may be an internal combustion engine and may generate power by combusting a fuel in the presence of an oxidant. The fuel may include, but is not limited to, a gasoline-type fuel, a diesel-type fuel, a jet-type fuel, a blended fuel including gasoline-, diesel-, and jet-type fuels as well as a blending agent such as ethanol, or any other fuel. The oxidant may be air, pure oxygen, a combination thereof, or any other oxidant.

In some embodiments, the engine includes at least one cylinder and at least one piston that facilitate combustion, from which power is generated. The piston may facilitate combustion by following a cycle, such as a four-stroke cycle including an intake stroke, a compression stroke, an expansion or power stroke, and an exhaust stroke, or any other combustion cycle. As combustion occurs in the engine, the fuel and oxidant are converted into products and heat is released. Part of the released heat is transferred to the cylinder and other components of the engine. The piston may direct the power generated by the combustion cycle to provide output power. The engine may be provided alone, as part of a mower, as part of a pressure washer, or as part of still another piece of power equipment. The cooling fan as described herein provides a flow of air to cool the engine that has increased in temperature due to combustion, without excessive noise. In some embodiments, the cooling fan reduces air turbulence (e.g., around the tip of a fin, as the fins rotate and drive the surrounding air, etc.), thereby reducing noise traditionally generated by turbulence. In some embodiments, the spacing between the tip of a fin and a surrounding housing is increased (e.g., relative to traditional cooling fan systems, etc.) or otherwise specified to decrease blade pass frequency and thereby reduce blade pass noise.

Figure 1:
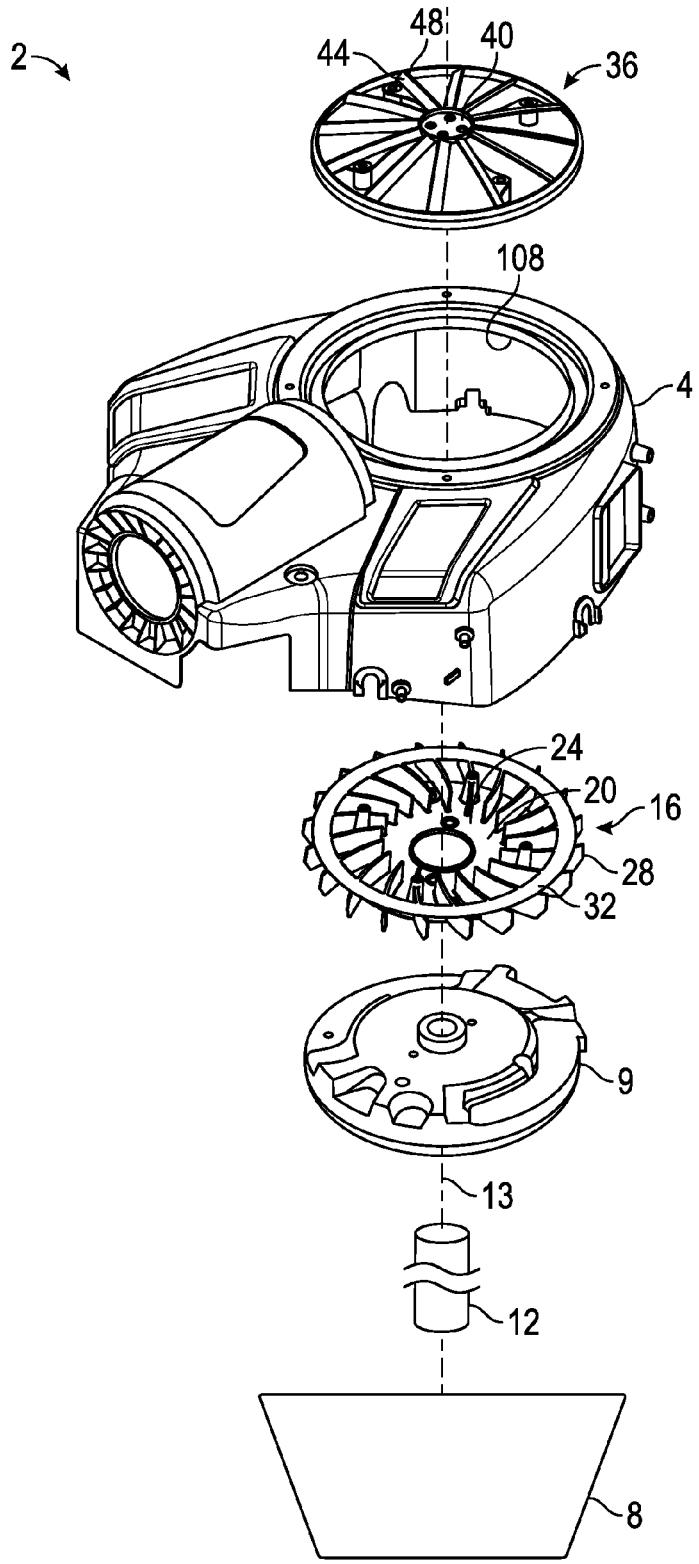
FIG. 1 is an exploded perspective view of an engine assembly having a cooling fan.

Referring to FIG. 1, an engine assembly 2 includes a housing 4, a crankcase 8, a flywheel 9, a shaft 12, a cooling fan 16, and a screen 36. The shaft 12 is coupled to the crankcase 8 and defines a rotational axis 13. The housing 4 has a sidewall 108 that defines an internal space. When the engine assembly 2 is assembled, the cooling fan 16 is disposed at least partially within the internal space of the housing 4 and is coupled to the shaft 12. By way of example, the flywheel 9 may be coupled to the shaft 12, and the cooling fan 16 may be coupled to the flywheel 9. The cooling fan 16 includes a plate 20, a band 32, and a plurality of reversed fins 28. When the engine assembly 2 is assembled, the screen 36 is coupled to the cooling fan 16 and disposed above the plurality of fins 28. The screen 36 includes a hub 40 positioned orthogonal to the rotational axis 13 and a plurality of blades 44 extending radially outward from the hub 40.

Figure 2:
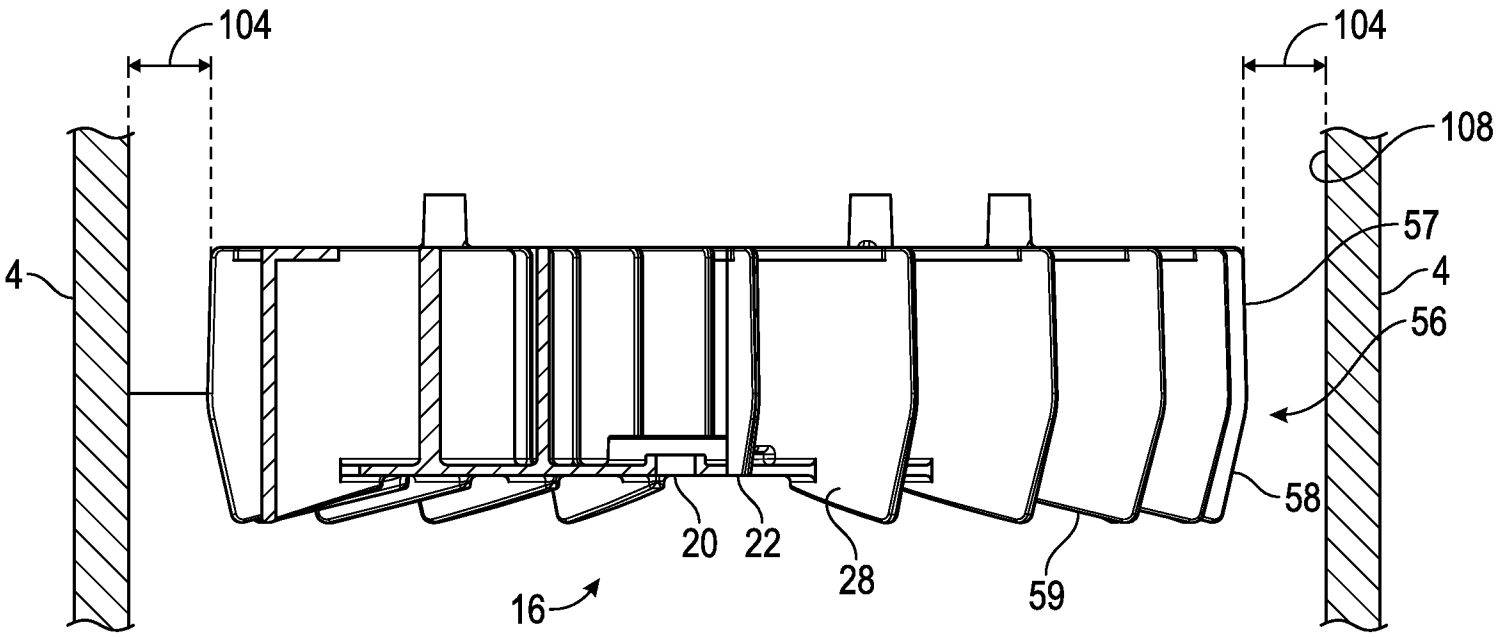
FIG. 2 is a sectional view of a housing and a cooling fan of the engine assembly of FIG. 1.

Referring to FIG. 2, the housing 4 and the cooling fan 16 cooperate to cool the engine assembly 2 and subcomponents of the engine assembly 2. In one embodiment, the distance 104 between the housing 4 and the tips 56 of the plurality of fins 28 is not more than 2 inches. The distance 104 may be defined as the shortest distance from the tip 56 to the sidewall 108 of the housing 4. This spacing aids in directing air flow in a manner so as to reduce turbulence and blade pass frequency and thereby reduce noise. In some embodiments, the distance 104 is less than one inch. In one embodiment, the distance 104 is about 0.75 inches.

In some embodiments, the cooling fan 16 and the screen 36 of the engine assembly are coupled to co-rotate (e.g., by being integrally formed and defining a single unitary body, etc.). In some embodiments, the band 32 is continuous between the cooling fan 16 and the screen 36. In some embodiments, another portion of the cooling fan 16 is continuous with the screen 36 such that the cooling fan 16 and the screen 36 are integrally formed and define a single unitary body. In some embodiments, the shaft 12 is coupled with each of the cooling fan 16 and the screen 26, causing them to co-rotate. The shaft 12 may be connected to a crankshaft 11 of the engine assembly 2 (e.g., with gears, directly, etc.), such that the shaft 12 rotates in the rotational axis 13 based on output from the crankshaft 11.

Figure 3:
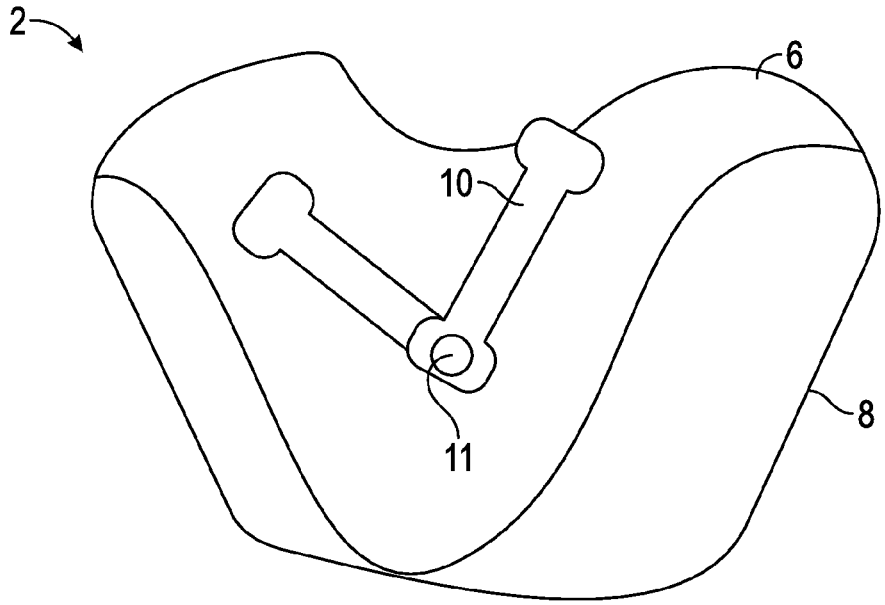
FIG. 3 is a cutaway schematic diagram of an engine having two cylinders in a V-twin configuration.
Figure 4A:
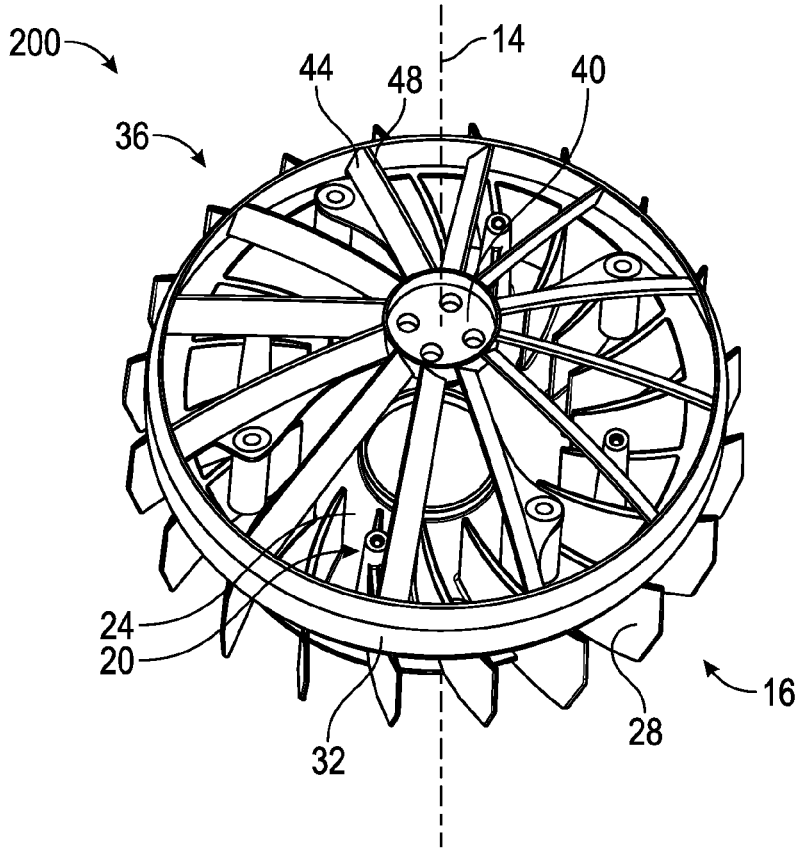
FIG. 4A is a perspective view of a fan assembly for an engine that includes a cooling fan and a screen.
Figure 4B:
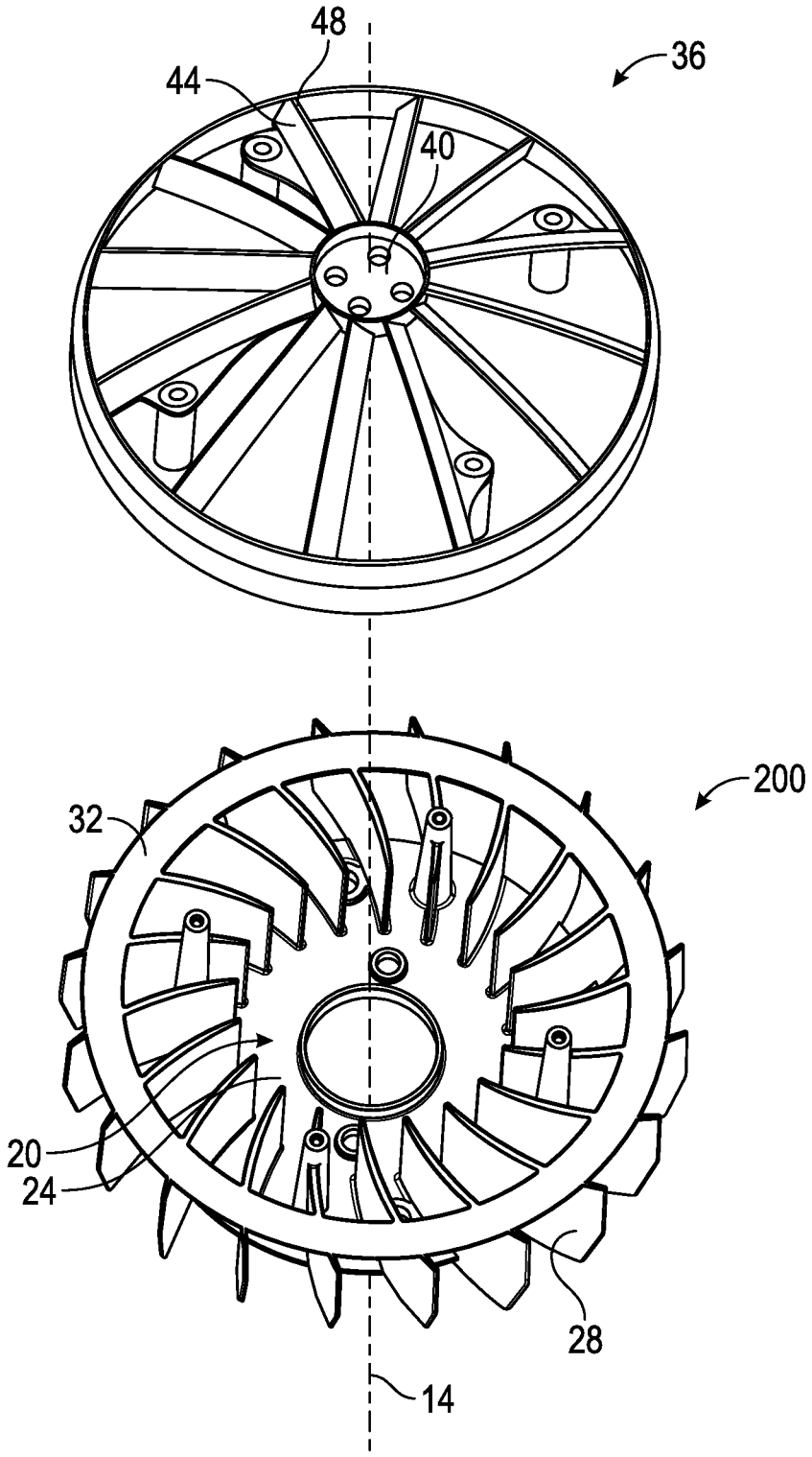
FIG. 4B is an exploded perspective view of the fan assembly of FIG. 4A.
Figure 5:
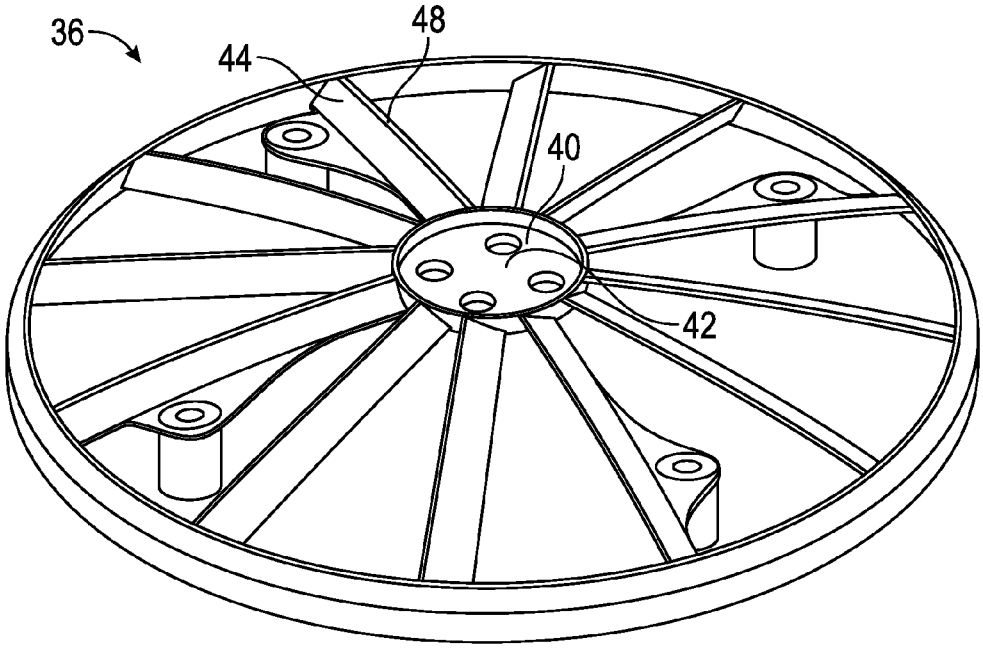
FIG. 5 is a perspective view of the screen of FIG. 4A.

Referring to FIG. 3, the engine assembly 2 includes a pair of pistons 10 that are received in a pair of cylinders 6. The cylinders 6 are in a V-twin configuration. While in FIG. 3, the pistons 10 are shown in a single-pin configuration such that they rotate a crankshaft 11 of the engine assembly 2 in unison, the pistons 10 may be arranged in any pin configuration, such as a double-pin configuration. The crankshaft 11 is configured to rotate in response to actuation of the pair of pistons 10 to provide an output to rotate the shaft 12.

Referring to FIGS. 4A-6E, a fan assembly 200 is shown, including the cooling fan 16 and the screen 36. The cooling fan 16 defines a central axis 14. The cooling fan 16 includes a plate 20 defining an upper surface 24 and a lower surface 22. The cooling fan 16 includes a band 32, and a plurality of reversed fins 28. The screen 36 is coupled to the cooling fan 16, and disposed along the plurality of reversed fins 28. The screen 36 includes a hub 40 positioned orthogonal to the central axis 14 and a plurality of blades 44 extending radially outward from the hub 40. A leading edge 48 is the thinnest cross-sectional portion of each of the plurality of blades 44, according to one embodiment.

Referring to FIGS. 6A-7C, the band 32 of the cooling fan 16 has an inner band radius 124 and an outer band radius 125. The plurality of reversed fins 28 of the cooling fan 16 are coupled to the band 32 and extend from the upper surface 24 of the plate 20. The fins 28 also extend radially outward from the central axis 14 along a plurality of paths that are concave relative to a clockwise direction 15 when viewed from above the cooling fan 16. The plurality of reversed fins 28 extend from a plurality of roots 52 positioned a root radius r from the central axis 14 to a plurality of tips 56 positioned a tip radius t from the central axis 14. The tip radius t is greater than the outer band radius 125 such that the plurality of tips 56 protrude further radially outward from the central axis 14 than the band 32. In some embodiments, the plurality of roots 52 are spaced from the central axis 14 and define a cavity 53 (as shown in FIG. 6B). In some embodiments, the plate 20 and the plurality of reversed fins 28 are integrally formed and define a single unitary body.

Figure 6A:
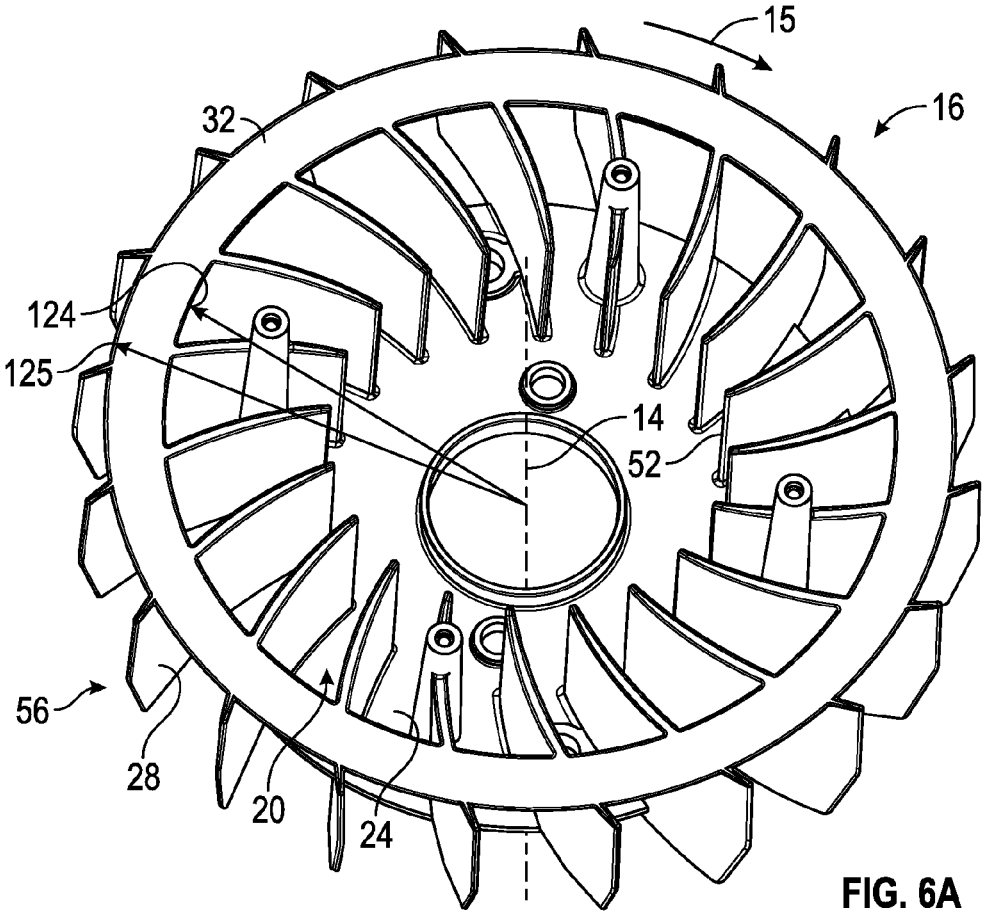
FIG. 6A is a perspective view of the cooling fan of FIG. 4A.

Referring specifically to FIG. 6A, the cooling fan 16 is shown to include twenty fins 28. In other embodiments, the cooling fan 16 includes more or fewer fins. The plurality of fins 28 may have a thickness that is increased or decreased depending on the number of fins 28. For example, the plurality of fins 28 may have a minimum or maximum weight requirement, and the thickness of the fins 28 may be altered to meet such a weight requirement. Alternatively, in some embodiments, the thickness of the fins 28 is held constant, and the number of fins 28 is modified to meet such a weight requirement. In some embodiments, the fins 28 have at least one of the same length, the same curvature, and the same shape.

Figure 6B:
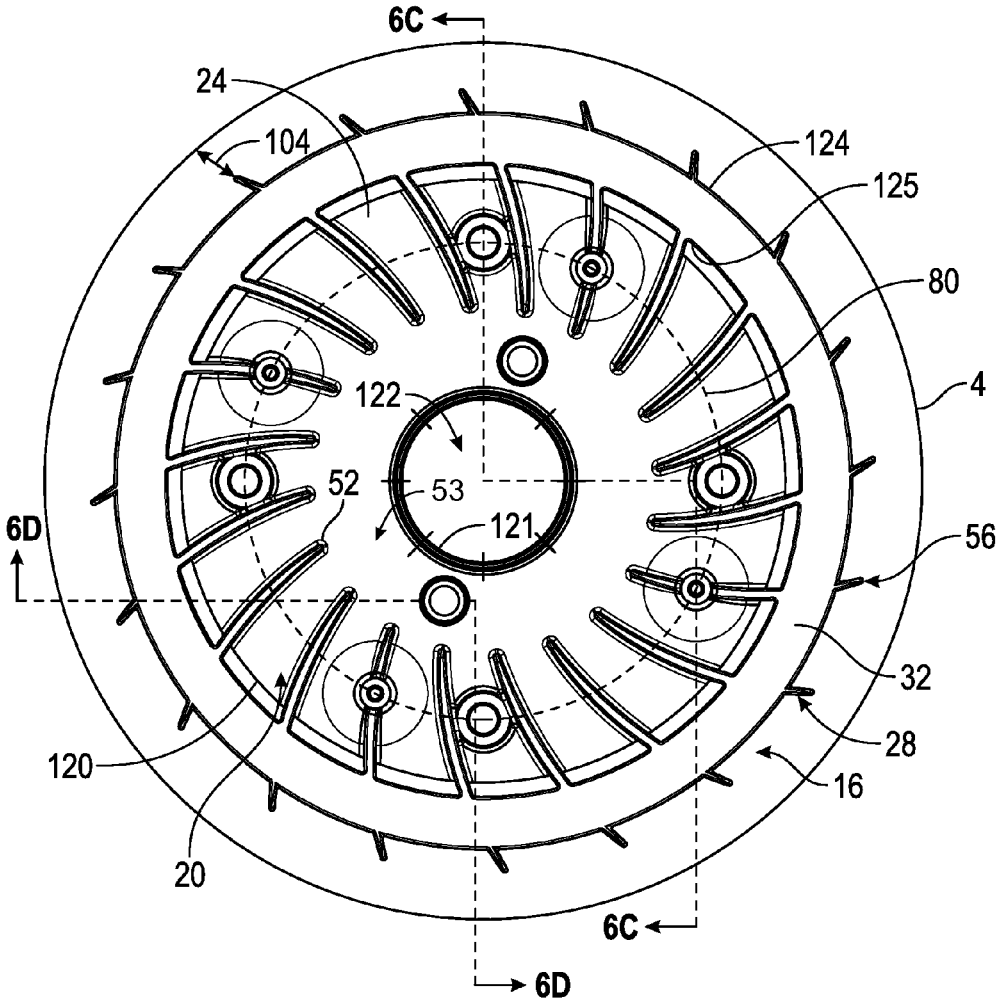
FIG. 6B is a top view of the cooling fan of FIG. 6A.
Figure 6C:
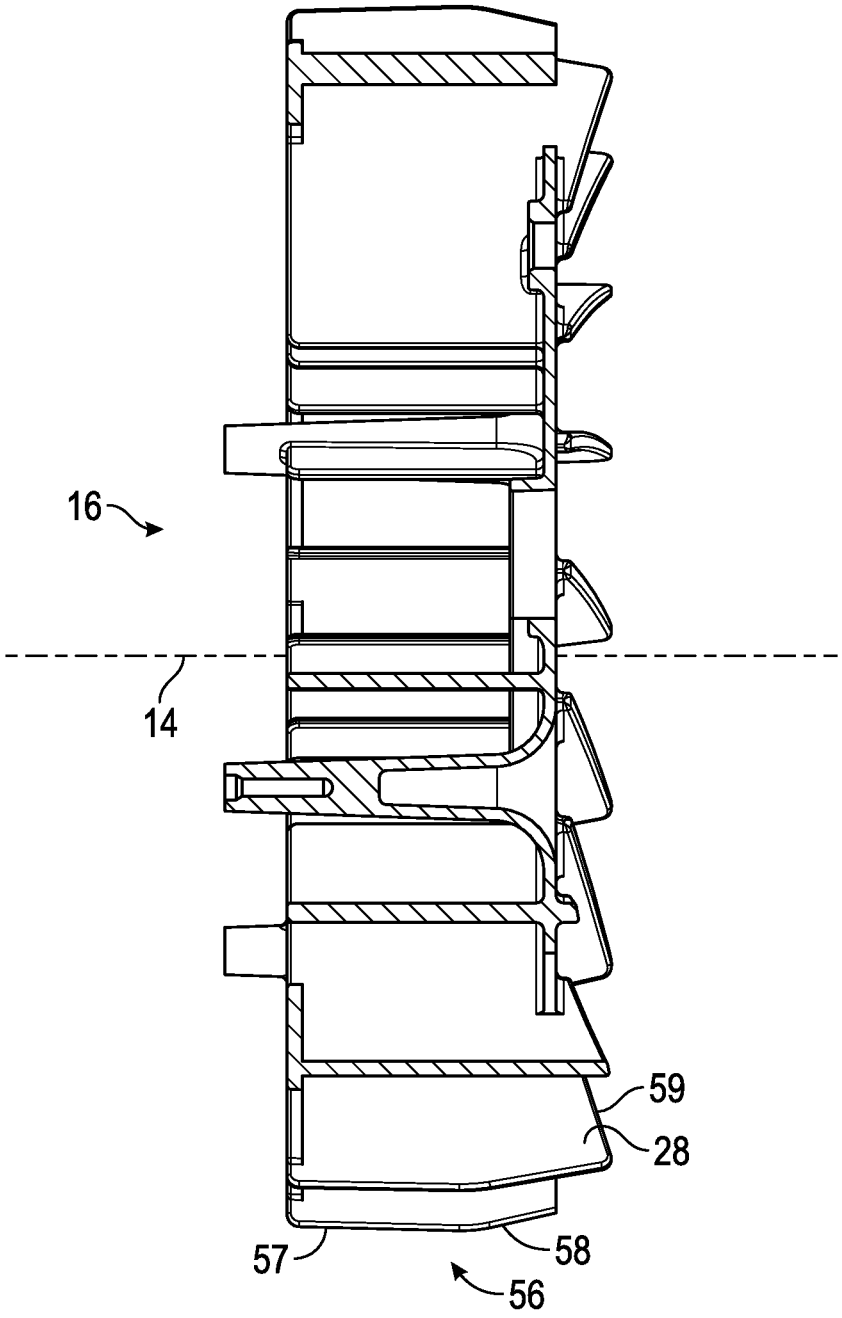
FIG. 6C is a sectional view of the cooling fan of FIG. 6A.

Referring specifically to FIG. 6B, a top view of the cooling fan 16 is shown, and the plurality of fins 28 of the cooling fan 16 are spaced equally around a periphery of the plate 20. In embodiments where the cooling fan 16 includes twenty fins 28, the fins 28 may be spaced apart by 18 degrees. In other embodiments, the fins 28 are non-uniformly spaced. In some embodiments, at least one of the number and the spacing of the fins 28 decreases the blade pass frequency thereby reducing the noise generated by blade pass.

Figure 6D:
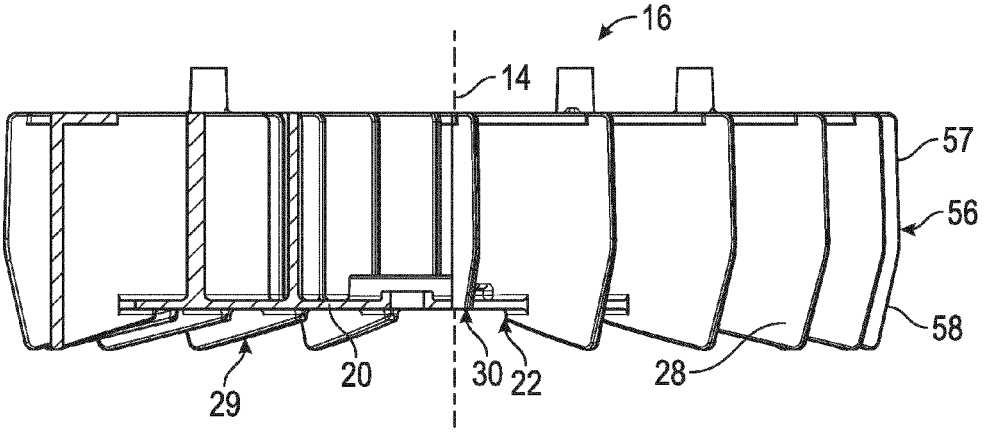
FIG. 6D is a sectional view of the cooling fan of FIG. 6A.
Figure 6E:
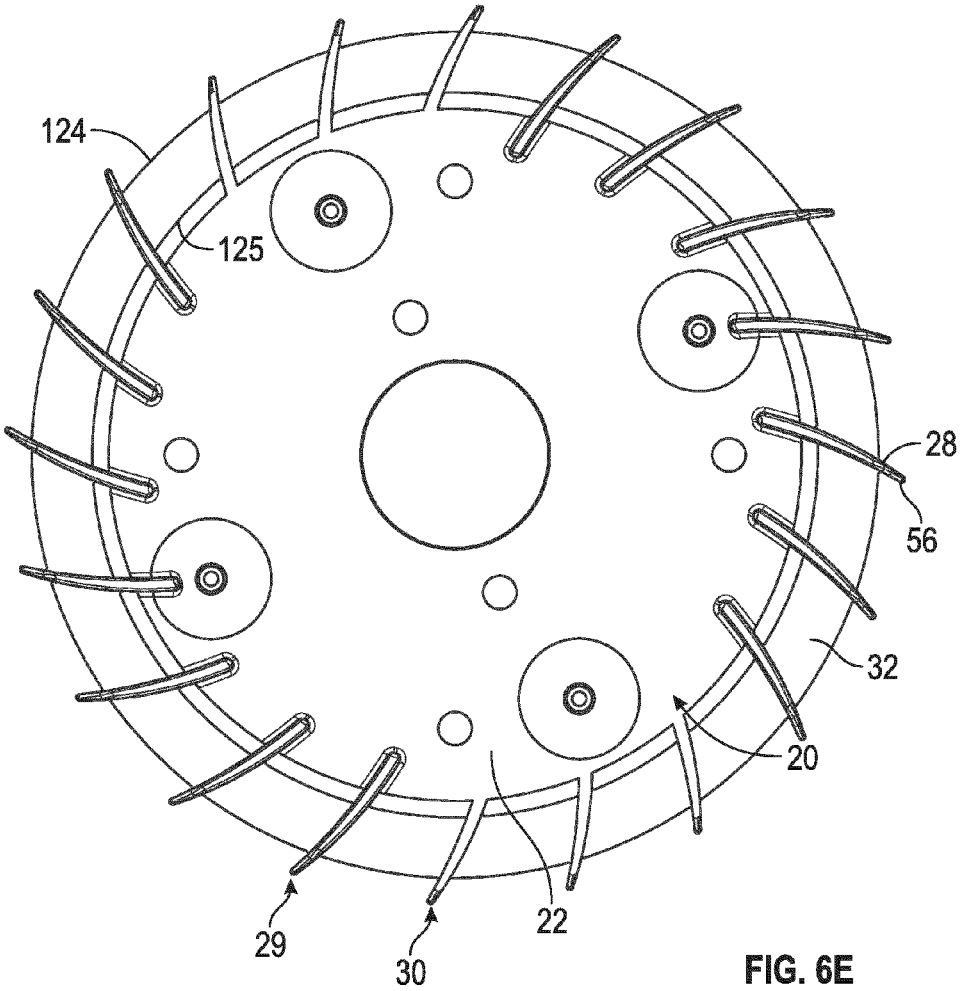
FIG. 6E is a bottom view of the cooling fan of FIG. 6A.

Referring to FIGS. 6D and 6E, in some embodiments, a first subset 29 of the plurality of reversed fins 28 extends below the lower surface 22 of the plate 20, and a second subset 30 of the plurality of reversed fins 28 extends to a plurality of points that are flush with the lower surface 22 of the plate 20. In other embodiments, the fins 28 all extend below the lower surface 22. In still other embodiments, the reversed fins 28 all extend to a plurality of points that are flush with the lower surface 22.

Figure 7A:
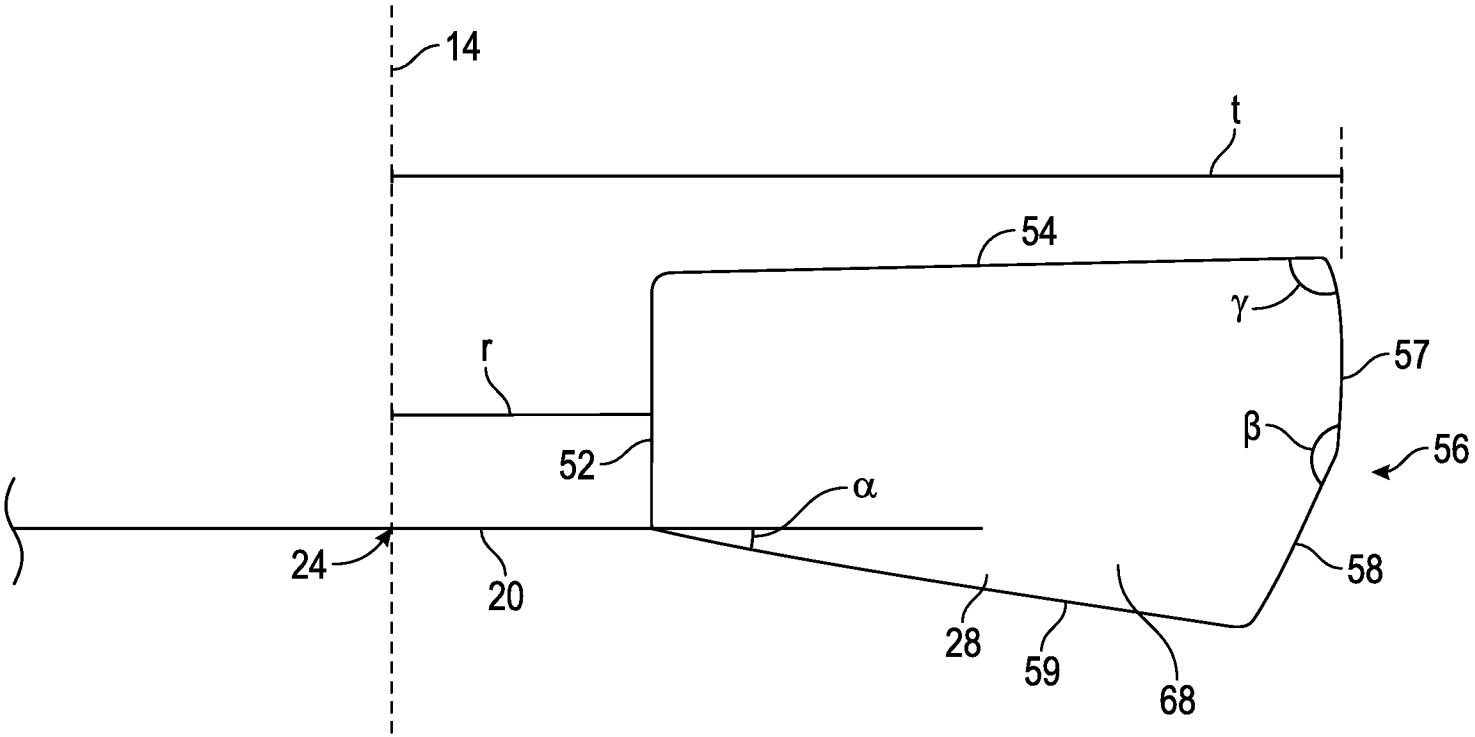
FIG. 7A is a partial detail view of a fin of the cooling fan of FIG. 6A, according to one embodiment.

Referring to FIG. 7A, a fin 28 of the cooling fan 16 is shown that includes a first edge 54, a second edge 57, a third edge 58 adjoining the second edge 57, and a fourth edge 59 adjoining the third edge 58. The fin also includes a root 52 positioned a root radius r from the central axis 14, and a tip 56 positioned a tip radius t from the central axis 14. The third edge 58 is angularly offset by an angle β from the second edge 57. In one embodiment, angle β is between 150 degrees and 180 degrees (e.g., 167 degrees, etc.). The fourth edge 59 is angularly offset by an angle α from the plate 20. In one embodiment, angle α is no more than 30 degrees (e.g., 15 degrees, etc.). The first edge 54 is angularly offset by an angle γ from the second edge 57. In some embodiments, the angle γ is 90 degrees. At least one of the angles α, β, and γ are specified to reduce noise (e.g., by reducing turbulence caused by rotation of the cooling fan, by reducing blade pass frequency, etc.).

Figure 7B:
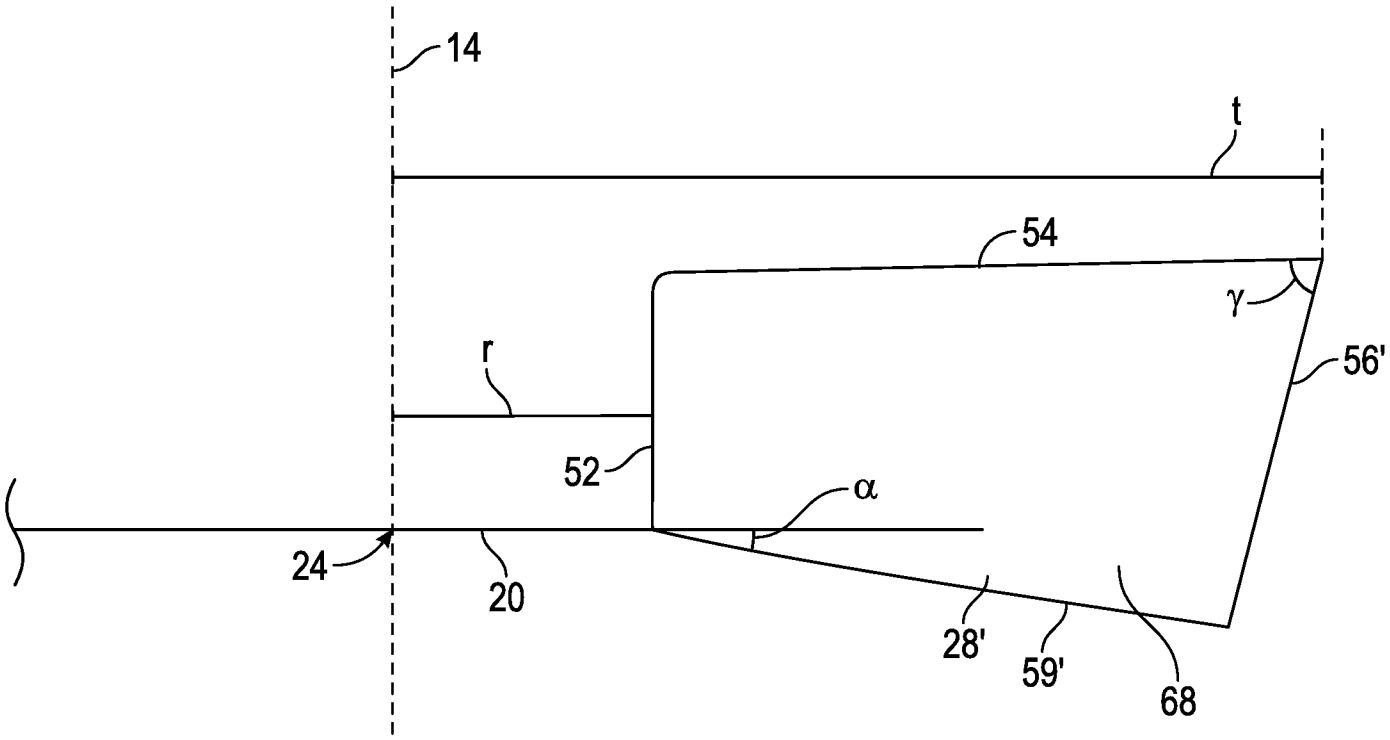
FIG. 7B is a partial detail view of a fin for a cooling fan, according to another embodiment.

Referring to FIG. 7B, a fin 28' is shown that includes an edge 54, a tip 56', and an edge 59'. The fin includes a root 52 positioned a root radius r from the central axis 14, and the tip 56' is positioned a tip radius t from the central axis 14. The edge 59' is angularly offset by an angle α from the plate 20. In one embodiment, angle α is no more than 30 degrees (e.g., 15 degrees, etc.). The edge 54 is angularly offset by an angle γ from the tip 56'. In one embodiment, angle γ is no more than 90 degrees (e.g., 45 degrees, 60 degrees, etc.). At least one of the angles α and γ are specified to reduce noise (e.g., by reducing turbulence caused by rotation of the cooling fan, by reducing the blade pass frequency, etc.). In one embodiment, the tip 56' forms an edge have various portions that are spaced different distances from a housing 4 within which the cooling fan 16 is disposed. By way of example, the housing 4 may have a vertical sidewall, and the angle γ may be specified such that the spacing between the tip 56' and the housing 4 varies according to a target profile along a height of the fin 28'. As shown in FIG. 7B, the spacing between the tip 56' and the housing 4 varies linearly along the height of the fin 28'. Such variation in the spacing between the tip 56' and the housing 4 may further reduce noise by decreasing the blade pass frequency and the turbulence associated with rotation of the cooling fan 16.

Figure 7C:
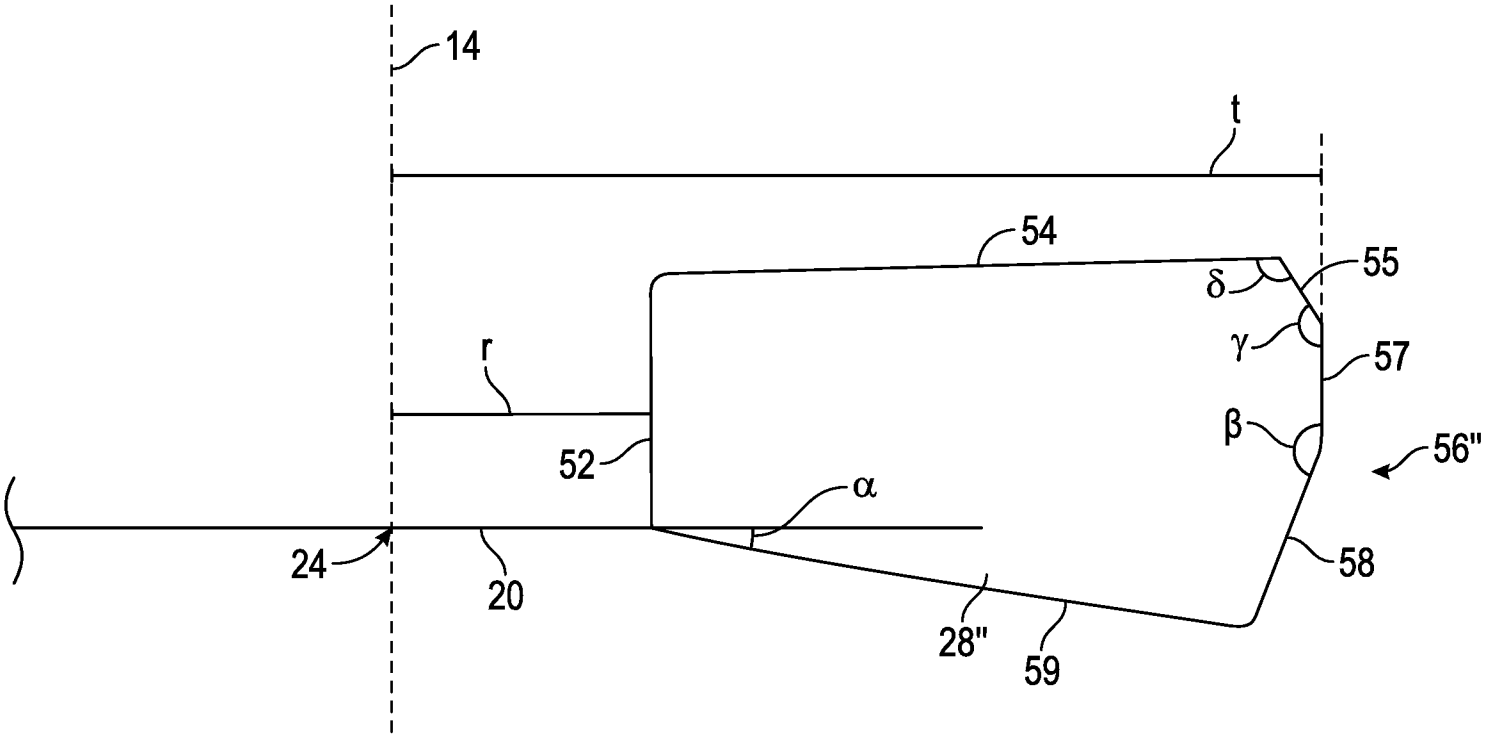
FIG. 7C is a partial detail view of a fin for a cooling fan, according to still another embodiment.

Referring to FIG. 7C, a fin 28" is shown that includes a first edge 54, a second edge 55, a third edge 57, a fourth edge 58, and a fifth edge 59. The fin also includes a root 52 positioned a root radius r from the central axis 14, and a tip 56" positioned a tip radius t from the central axis 14. The fifth edge 59 is angularly offset by an angle α from the plate 20. In one embodiment, angle α is no more than 30 degrees (e.g., 15 degrees, etc.). The second edge 55 is angularly offset by an angle β from the third edge 57. In one embodiment, angle β is between 150 degrees and 180 degrees (e.g., 167 degrees, etc.). The first edge 54 is angularly offset by an angle δ from the second edge 55. In one embodiment, angle δ is greater than 90 degrees and less than 180 degrees (e.g., 120 degrees, 150 degrees, etc.). At least one of the angles α, β, γ, and δ are specified to reduce noise (e.g., by reducing turbulence caused by rotation of the cooling fan, by reducing the blade pass frequency, etc.).

The construction and arrangement of the apparatus, systems, and methods as shown in the various exemplary embodiments are illustrative only. Although only a few embodiments have been described in detail in this disclosure, many modifications are possible (e.g., variations in size, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

What is claimed is:

1. An engine assembly, comprising:
- a crankcase;
- a shaft coupled to the crankcase and defining a rotational axis;
- a housing having a sidewall that defines an internal space; and
- a cooling fan disposed at least partially within the internal space and coupled to the shaft, the cooling fan comprising:
  - a plate defining an upper surface and a lower surface, wherein the plate is positioned to rotate with the shaft about the rotational axis;
  - a band having an inner band radius and an outer band radius; and
  - a plurality of reversed fins coupled to the band and extending from the upper surface of the plate, the plurality of reversed fins extending radially outward from the rotational axis along a plurality of paths that are concave relative to a clockwise direction when viewed from above the cooling fan,
  - wherein the plurality of reversed fins extend further radially outward from the rotational axis than the band.

2. The engine assembly of claim 1, wherein the plurality of reversed fins include a plurality of roots that are spaced from the rotational axis and define a cavity that is disposed above the plate.

3. The engine assembly of claim 2, wherein the plurality of reversed fins include a plurality of tips that are spaced a distance of not more than 2 inches from the sidewall of the housing.

4. The engine assembly of claim 3, wherein the plurality of tips are spaced a distance of about 0.75 inches from the sidewall of the housing.

5. The engine assembly of claim 3, further comprising a screen coupled to the cooling fan and disposed above the plurality of reversed fins, the screen including a hub positioned orthogonal to the rotational axis and a plurality of blades extending radially outward from the hub.

6. The engine assembly of claim 5, wherein the cooling fan and the screen are integrally formed and define a single unitary body.

7. The engine assembly of claim 1, further comprising a pair of pistons, a pair of cylinders in a V-twin configuration that receive the pair of pistons, and a crankshaft coupled to the pair of pistons and the shaft, wherein the crankshaft is configured to rotate in response to actuation of the pair of pistons to provide an output to rotate the shaft.

8. A fan assembly, comprising:
- a cooling fan defining a central axis, the cooling fan including:
  - a plate defining an upper surface and a lower surface;
  - a band having an inner band radius and an outer band radius; and
  - a plurality of reversed fins coupled to the band and extending from the upper surface of the plate, the plurality of reversed fins extending radially outward from the central axis along a plurality of paths that are concave relative to a clockwise direction when viewed from above the cooling fan, wherein the plurality of reversed fins extend to a plurality of tips that are positioned further radially outward from the central axis than the band; and a screen coupled to the cooling fan and disposed along the plurality of reversed fins, the screen including:

a hub positioned orthogonal to the central axis; and a plurality of blades extending radially outward from the hub, wherein a leading edge is the thinnest cross-sectional portion of each of the plurality of blades.

9. The fan assembly of claim 8, wherein the plurality of reversed fins include a plurality of roots that are spaced from the central axis and define a cavity that is disposed between the plate and the screen.

10. The fan assembly of claim 8, wherein the cooling fan and the screen are integrally formed and define a single unitary body.

11. The fan assembly of claim 8, wherein the plurality of reversed fins are spaced equally around a periphery of the plate.

12. The fan assembly of claim 8, wherein the plurality of reversed fins includes 20 fins.

13. A cooling fan, comprising:

a plate having an upper surface and a lower surface and defining a central axis;

a band having an inner band radius and an outer band radius; and a plurality of reversed fins coupled to the band and extending from the upper surface of the plate, the plurality of reversed fins extending radially outward from the central axis along a plurality of paths that are concave relative to a clockwise direction when viewed from above the cooling fan, wherein the plurality of reversed fins extend from a plurality of roots positioned a root radius from the central axis to a plurality of tips positioned a tip radius from the central axis, wherein the tip radius is greater than the outer band radius such that the plurality of tips protrude further radially outward from the central axis than the band.

14. The cooling fan of claim 13, wherein the plurality of roots are spaced from the central axis and define a cavity.

15. The cooling fan of claim 13, wherein the plate and the plurality of reversed fins are integrally formed and define a single unitary body.

16. The cooling fan of claim 13, wherein the plurality of reversed fins are spaced equally around a periphery of the plate.

17. The cooling fan of claim 16, wherein the plurality of reversed fins includes 20 fins.

18. The cooling fan of claim 13, wherein a first subset of the plurality of reversed fins extend below the lower surface of the plate, and wherein a second subset of the plurality of reversed fins extend to a plurality of points that are flush with the lower surface of the plate.

19. The cooling fan of claim 13, wherein each of the plurality of tips include a first edge, a second edge adjoining the first edge, and a third edge adjoining the second edge, wherein the second edge is angularly offset between 150 and 180 degrees from the first edge, and wherein the third edge is angularly offset no more than 30 degrees from the plate.

* * * * *